US009302138B2

(12) United States Patent
McCanney et al.

(10) Patent No.: US 9,302,138 B2
(45) Date of Patent: Apr. 5, 2016

(54) UPPER EXTREMITY TRAINING APPARATUS

(71) Applicants: Michael McCanney, Palm Bay, FL (US); Amar Patel, Indialantic, FL (US); David P. Jaeger, Palm Bay, FL (US)

(72) Inventors: Michael McCanney, Palm Bay, FL (US); Amar Patel, Indialantic, FL (US); David P. Jaeger, Palm Bay, FL (US)

( * ) Notice: Subject to any disclaimer, the term of this patent is extended or adjusted under 35 U.S.C. 154(b) by 64 days.

(21) Appl. No.: 14/153,143

(22) Filed: Jan. 13, 2014

(65) Prior Publication Data

US 2014/0274605 A1 Sep. 18, 2014

Related U.S. Application Data

(60) Provisional application No. 61/789,534, filed on Mar. 15, 2013.

(51) Int. Cl.

| | |
|---|---|
| ***A63B 21/04*** | (2006.01) |
| ***A63B 9/00*** | (2006.01) |
| ***A63B 7/04*** | (2006.01) |
| ***A63B 23/14*** | (2006.01) |
| ***A63B 23/16*** | (2006.01) |
| ***A63B 21/02*** | (2006.01) |
| ***A63B 69/00*** | (2006.01) |
| ***A63B 21/00*** | (2006.01) |
| ***A63B 23/035*** | (2006.01) |
| *A63B 21/055* | (2006.01) |
| *A63B 21/16* | (2006.01) |

(52) U.S. Cl.

CPC ..... *A63B 21/0428* (2013.01); *A63B 21/00065* (2013.01); *A63B 21/1469* (2013.01); *A63B 21/169* (2015.10); *A63B 21/4035* (2015.10); *A63B 23/03508* (2013.01); *A63B 23/14* (2013.01); *A63B 23/16* (2013.01); *A63B 69/0048* (2013.01); *A63B 21/023* (2013.01); *A63B 21/0552* (2013.01); *A63B 2021/169* (2013.01)

(58) Field of Classification Search

CPC ..... A63B 21/0428; A63B 21/0407; A63B 21/1469; A63B 21/023; A63B 21/0552; A63B 21/055; A63B 21/0557; A63B 69/0048; A63B 23/03508; A63B 23/16; A63B 2021/169

See application file for complete search history.

(56) References Cited

U.S. PATENT DOCUMENTS

| | | | | |
|---|---|---|---|---|
| 1,620,910 | A * | 3/1927 | Minnich | 482/126 |
| 5,406,845 | A * | 4/1995 | Berger et al. | 73/379.09 |
| 8,894,551 | B2 * | 11/2014 | Kerdjoudj | 482/70 |
| 2013/0337982 | A1 * | 12/2013 | Williams | 482/122 |

OTHER PUBLICATIONS

Rock & Ice Magazine, Issue 139, Jan. 2005, Wood Grips Training Board, p. 16.

* cited by examiner

*Primary Examiner* — Loan H Thanh
*Assistant Examiner* — Megan Anderson

(57) ABSTRACT

An apparatus for training the upper extremities is taught and claimed. The invention comprises a paddle subassembly adapted to slidingly engage with a mount subassembly. A user interacts with the apparatus by pulling on a climbing hold located on the paddle subassembly. The paddle subassembly offers increasing resistance to the user, thus increasing the strength and endurance of the muscle groups exercised. Resistance elements such as, for example, bungee cords and the like are used to provide resistance. The climbing hold is interchangeable, thus allowing the use of various styles and shapes of climbing holds in order to provide a variety of strength exercises for the hands. The slide of the invention is adapted to rotate to a plurality of discrete angles. The invention is particularly useful and training the muscles of the fingers, hands, wrists and forearms in preparation for rock climbing activities.

24 Claims, 11 Drawing Sheets

UPPER EXTREMITY TRAINING APPARATUS

CROSS REFERENCE TO RELATED APPLICATIONS

This application for patent is a non-provisional application, which claims the benefit of U.S. provisional application Ser. No. 61/789,534 filed in the United States Patent and Trademark Office on Mar. 15, 2013 and which is incorporated herein in its entirety by reference.

STATEMENT REGARDING FEDERALLY SPONSORED RESEARCH OR DEVELOPMENT

Not applicable.

INCORPORATION-BY-REFERENCE OF MATERIAL SUBMITTED ON A COMPACT DISK

Not applicable.

BACKGROUND OF THE INVENTION

1. Field of the Invention

The invention is an apparatus which is useful for training the upper extremities of an individual with respect to certain sporting activities which require finger, hand, wrist, and forearm strength as well as general upper body strength. More specifically, the invention relates to the field of training devices and apparatuses intended to strengthen the upper extremities of rock climbers and the like. The apparatus of the invention uses resistance, realistic handholds, and a range of motion to train the fingers, hands, upper extremities, and upper body of the user in order to better enable them to partake in rock climbing and similar activities.

2. Background Art

Training equipment and programs for upper extremity sports, such as rock climbing, have been in existence for a number of years, and have been used with varying degrees of success. Such training programs generally seek to increase the upper extremity body strength of the person in order to increase strength to weight ratio, tone the muscles of the upper extremities, especially the fingers and hands, and to train the muscles in order to remain flexed and weight-bearing for increasing periods of time in the range of 30 seconds to 60 seconds or even longer.

As an example, simple torsion resistance handgrips have been suggested as one means for training the fingers, hands, wrists and forearms in preparation for rock climbing. While simple torsion resistance handgrips are easy to use, small and convenient, and can be carried so the training can occur at virtually any location, they lack the realistic feel and structure of the typical handhold structures encountered during actual rock climbing, and therefore do not provide an adequate job of training, especially, the finger muscles to grip and hold a typical rock climbing hold as would be encountered in either the gymnasium or outdoors rock climbing on, for instance, stone structures. Therefore, simple torsion resistance handgrips are not optimum devices for such training.

Another technique of the prior art used for training the muscles of the fingers, hands and wrists is the fingertip push-up. The fingertip push-up is an exercise that incorporates isotonic contractions of the chest, shoulders, and triceps, and isometric exercise for the hands. A fingertip pushup is performed as a standard pushup, but instead of resting the palms flat on the supporting surface, which may be, for example, a floor, the user supports themselves with their fingertips only.

Although this exercise is excruciating for most beginners, hand-strength may improve with regular training. However, fingertip push-ups exhibit the same shortcoming as the torsion resistance handgrips described above, in that they do not train the muscles of the fingers and hands to grip and hold a typical rock climbing hold as would be encountered either in the gymnasium or outdoors.

Another technique for strengthening the muscles of the fingers, hands, wrists and forearms is to simply do more rock climbing in either a gymnasium or outdoor setting. However, such rock climbing sessions typically take more time than is available during the average working day, as a rock climbing session may last anywhere from one to five hours or longer, especially if the rock climbing is done outdoors and in a remote environment. In such cases, travel time to and from the rock climbing site or gymnasium must also be taken into account. Thus, the opportunities to participate in actual rock climbing, in either indoor or outdoor setting, may be restricted by the available time in the day. Weather may also play a role in reducing the time available for rock climbing. Furthermore, training by simply doing more rock climbing does not allow an individual to incrementally change the training resistance parameters in order to systematically increase strength. Simply training by rock climbing may lead to discouragement if systematic, measurable incremental progress is not seen by the climber.

What is needed therefore is an effective apparatus and method for training the fingers, hands, wrists, and forearms of the user that, preferably, simulates an actual rock climbing environment, and is adaptable to be used in a home or other convenient setting without requiring travel to remote climbing sites, gymnasium sessions, or identification of outdoor climbing facilities in order to be utilized. The present invention provides these features, and overcomes the shortcomings of the prior art by operation of its novel and unique feature set.

BRIEF SUMMARY OF THE INVENTION

The present invention comprises a system and/or method that has one or more of the following features and/or steps, which alone or in any combination may comprise patentable subject matter.

In accordance with a preferred embodiment of the present invention, the invention comprises three major subassemblies: 1) a base plate; 2) a mount subassembly which includes a mount platform, rails, a rubber bumper, provisions to retain at least one resistance element such as, for example, a bungee cord, an elastic cord, springs, or pneumatic cylinder, and hardware such as threaded fasteners and pins which aid in assembling the mount subassembly together and; 3) a paddle subassembly which comprises a top, at least one bottom further comprising paddle rail surfaces for sliding engagement with the mount rail surfaces, at least one resistance element such as, for example, a bungee cord, an elastic cord, springs, or pneumatic cylinder, a climbing hold for gripping by a user and hardware such as threaded fasteners and pins which aid in assembling the paddle subassembly together. An alternate preferred embodiment of the invention comprises the mount subassembly and paddle subassembly with no base plate.

In a preferred embodiment, the paddle subassembly is slidingly engaged with the mount subassembly, such that the rails of the mount subassembly receive the rails of the paddle subassembly in a sliding engagement. The resistance element or elements provide resistance to sliding, such that when a user grips the interchangeable climbing hold on the paddle subassembly, which is preferably mounted on a top surface of the paddle, and pulls the climbing hold in such a manner as to extend and move the paddle in a sliding manner along the rails of the mount subassembly, an increasing resistance is offered to the fingers, hand, wrists, and forearms of the user, thus providing strengthening of the upper extremity being exercised. Repeated use of the improved upper extremity training apparatus system and method of the invention results in increased finger, hand, wrist, and forearm strength and is especially adapted to training the muscles of the fingers, hands, wrists, and forearm for use in rock climbing by the use of the actual rock climbing holds which are mounted onto the top surface of the paddle. In a preferred embodiment, the rock climbing hold mounted onto the top surface of the paddle is interchangeable, such that any hold commercially available or custom fabricated climbing hold may be utilized with the invention. Such holds are commonly used, for example, on the vertical walls of rock climbing gymnasiums. A large number of such climbing holds are commercially available at a reasonable price, which use a common hardware mounting scheme. Thus, a user of the improved upper extremity training apparatus of the invention may select any climbing hold desired in order to train for a particular ascent or to meet any other specific need of the user.

It is a further aspect of the invention that the mount platform may be further adapted to hold the mount at a variety of angles with respect to vertical, such that a user of the invention may train the fingers, hands, wrists, and forearms to strengthen in a variety of orientations, thereby exercising various muscle groups and training the user for actual rock climbing scenarios in which rock climbing holds may not be perfectly oriented to a horizontal or vertical axis. Such off-axis rock climbing holds are typically encountered in outdoor rock climbing, but may be encountered in indoor rock climbing as well.

It is a further aspect of the invention that it may be mounted on a vertical wall in any location the user desires, such that it is readily accessible for use and may be accessed during the day at various times as the user may have available and thus does not require travel to a rock climbing gymnasium or outdoor rock climbing setting in order to perform training exercises.

Still further, the apparatus of the invention may be utilized for physical therapy or rehabilitation such as may be required to develop upper extremity strength, for example, after surgery, after recovering from a serious illness, or to simply maintain muscle tone.

BRIEF DESCRIPTION OF THE DRAWINGS

The accompanying drawings, which are incorporated into and form a part of the specification, illustrate one or more embodiments of the present invention and, together with the description, serve to explain the principles of the invention. The drawings are only for the purpose of illustrating the preferred embodiments of the invention and are not to be construed as limiting the invention. In the drawings.

DETAILED DESCRIPTION OF THE INVENTION

Figure 1:
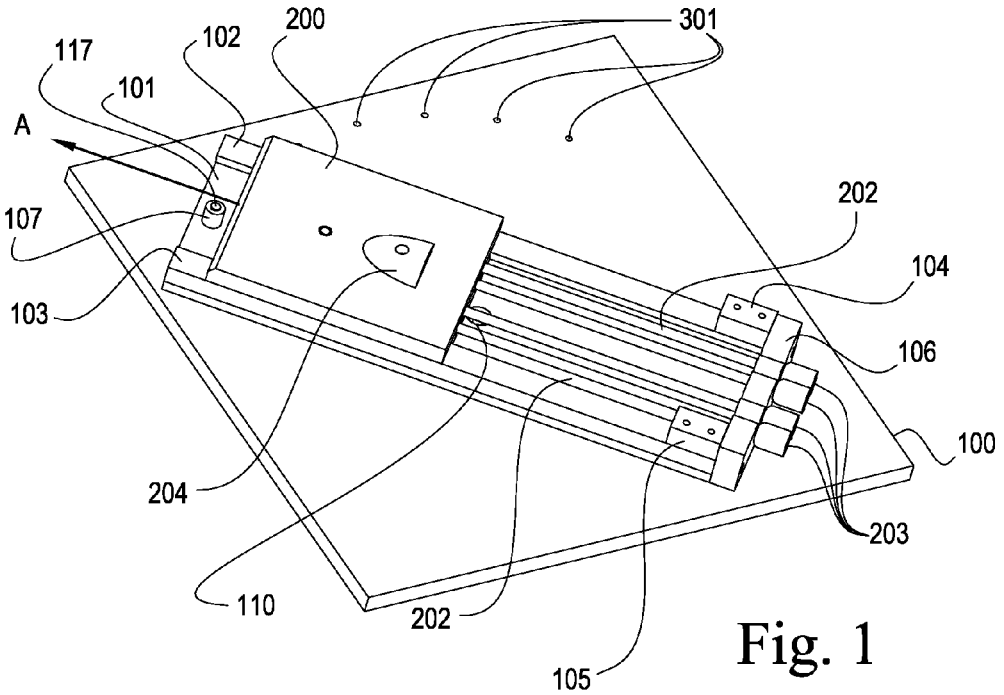
FIG. 1 depicts a perspective top view of a preferred embodiment of the improved upper extremity training apparatus of the invention, with the sliding paddle of the invention shown in an extended position.

The following documentation provides a detailed description of the invention. As used herein, "lengthwise" means running in the direction of travel of the paddle subassembly as it translates by operation of the sliding engagement between the paddle subassembly and the mount subassembly when motivated by a user.

In the attached FIGS. 1-6*b*, embodiments of the improved upper extremity training apparatus of the invention are described in the form of three major subassemblies, which are now described for purposes of reference. The first major subassembly is the paddle subassembly of the invention, which is comprised of paddle top 200, paddle bottom 201, resistance elements 202, resistance elements end caps 203, climbing hold 204, and the various hardware elements required to assemble the components of the paddle subassembly herein described. The second major subassembly is the mount subassembly, which may be comprised of mount platform 101, first mount rail 102, second mount rail 103, first mount bumper 104, second mount bumper 105, resistance element bulkhead 106, rear bumper 107, and the various hardware elements required to assemble the components of the mount subassembly herein described. The third subassembly is base plate 100. A preferred embodiment of the invention may comprise base plate 100; or, alternatively, the invention may not comprise base plate 100 in which case the invention may comprise only the mount subassembly and paddle subassembly. In significant part, the paddle subassembly may be slidingly engaged with the mount subassembly by operation of the rail components described in further detail below, and the mount subassembly may be rotatably attached to base plate 100, also as discussed further below. In this manner, the mount subassembly may be oriented into any one of the number of discrete orientations on base plate 100, and, in each position, the paddle subassembly may be extended under resistance by a user wishing to strengthen his fingers, hands, wrists or forearms. The subassembly, interconnection, operation and other aspects of the various components of the invention are described in further detail below.

Figure 2:
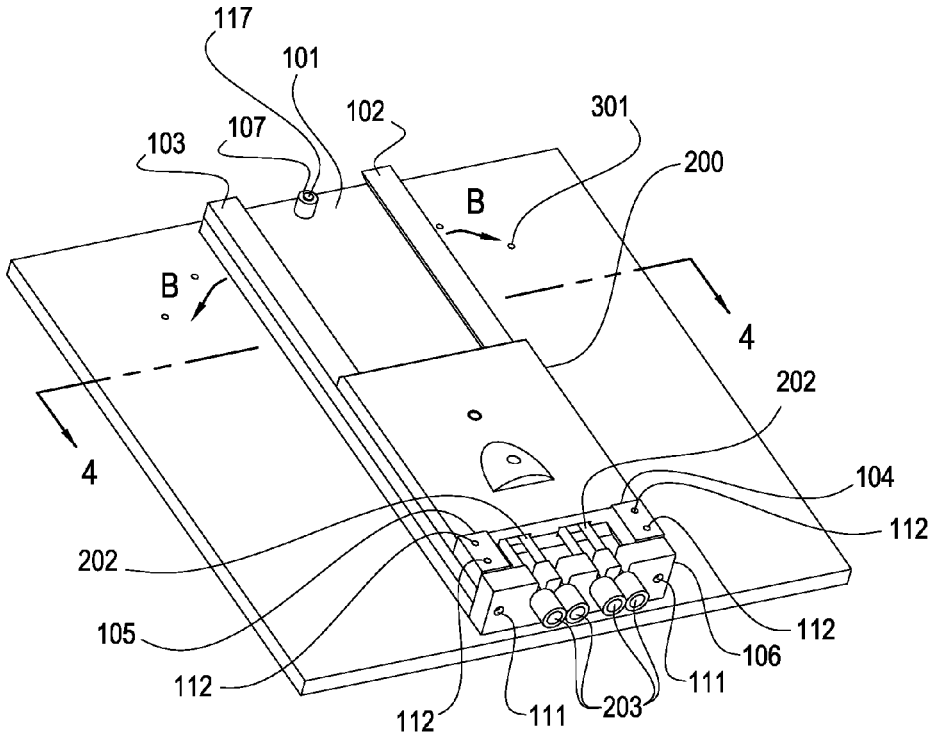
FIG. 2 depicts a perspective top view of a preferred embodiment of the improved upper extremity training apparatus of the invention, with the sliding panel of the invention shown in a resting position.

Referring now to FIG. 1, a top perspective view of a preferred embodiment of the invention is shown with the paddle subassembly in a fully extended position. In this position, resistance elements 202 are under tension, tending to pull the paddle subassembly back into its resting position against first mount bumper 104 and second mount bumper 105 which are attached to first mount rail 102 and second mount rail 103, respectively. In the preferred embodiment depicted in FIG. 1, resistance elements 202 may be comprised of, for example, bungee cord, elastic cord or any other elastic material that provides resistance to movement of the paddle subassembly in the direction shown by arrow A, and which may exhibit elastic characteristics such that the paddle subassembly is returned to its resting position by action of said elasticity of the resistance element. As used herein, "bungee cord" means any elasticized cord that may or may not have an exterior sheath. A bungee cord sheath, when used, allows the bungee cord to extend elastically and may be braided with strands spiraling around the core so that a longitudinal pull on the bungee cord may cause the sheath to squeeze the core, transmitting the core's elastic compression to the longitudinal extension of the sheath and cord. Resistance elements 202 may terminate in resistant element end caps 203 as shown in FIG. 1. Resistance element end caps 203 may be attached to resistance elements 202 in any manner known in the art such as, for example, crimping, knotting or any other means known in the art. Resistance element end caps 203 provide a structure for capturing the proximal ends of resistance elements 202 in place. Resistance elements 202 slide into and are retained in resistance element retaining slots 109 (not shown in FIG. 1) by operation of resistance element end caps 203 coming into contact with resistance element bulkhead 106 and being held in place with a slight tension. The retention of resistance elements 202 by operation of resistance element end caps 203 held in place against resistant element bulkhead 106, with resistance elements 202 passing through resistance elements retaining slots 109 (not shown in FIG. 1), is further depicted in FIG. 2. Resistance elements 202 are secured to the paddle subassembly by looping around first and second resistance element retaining pins 216 protruding from the paddle top 200 (not shown in FIG. 1, but shown in the exploded view of paddle top 200 in FIG. 3). First and second resistance element retaining pins 216 are of such length as to capture resistance elements 202 as they loop around first and second resistance element retaining pins 216 at resistance elements loop end 207 (not shown in FIG. 1, but shown in FIG. 3), but first and second resistance element retaining pins 216 are not so long as to bottom out on the upper surface of paddle bottom first and second grooves 214 and 215 (not shown in FIG. 1, but shown in FIG. 4). In an alternate embodiment, first and second resistance element retaining pins 216 may protrude from the top of paddle bottom 201 (not shown in FIG. 1) instead of protruding down from the underneath side of paddle top 200, but in either case first and second resistance element retaining pins 216 perform the same function of securing the resistance elements loop end 207 of resistance elements 202 to the paddle subassembly such that a user encounters resistance when pulling the paddle subassembly away from first mount bumper 104 and second mount bumper 105. In the preferred embodiment shown in the figures, first and second resistance element retaining pins 216 are present, one for each of the resistance elements 202. The looping of resistance elements 202 around first and second resistance element retaining pins 216 provides a point of attachment for resistance elements 202 to the paddle subassembly of the invention. Preferably, resistance elements 202 are of appropriate length to establish a slight tension in them when the paddle subassembly is positioned at the most proximal point of its travel, which is defined and referred to herein as the resting position, as is depicted in FIG. 2. As used herein, the extended position is defined as the point at the most distal end of the travel of the paddle subassembly as depicted in FIG. 1.

The rotatable attachment of the mount subassembly to the base plate of the invention is now discussed. Referring now still to FIG. 1, it can be seen that a series of mount platform angular retention holes 301 may be arranged in an arcurate fashion along the distal end of the base plate 100. Furthermore, it can be seen that mount platform pivot hole 300 (not shown in FIG. 1 but shown in FIG. 3) may exist in substantially the middle of base plate 100. A pivot point bolt 114 (not shown in FIG. 1) or other similar structure may protrude through the bottom surface of mount platform 101 by virtue of mount subassembly rotation counterbored hole 110 which preferably allows a pin, bolt or other similar structure to be completely recessed below the top surface of mount platform 101, and to protrude from the bottom of mount platform 101 and to rotatably engage mount platform pivot hole 300. Thus, the mount subassembly of the invention is able to rotate, or pivot, about the pivot point bolt 114, screw or other structure which is captured in mount platform pivot hole 300. The pivoting of the mount subassembly in this manner is depicted by arrows B as seen in FIG. 2. Still referring to FIG. 1, a series of mount platform angular retention holes 301 are adapted to accept, preferably, mount subassembly retaining pin 117 protruding from the underneath side of mount platform 101 allowing mount platform 101 to be oriented into any of the discrete positions provided by the plurality of mount platform angular retention holes 301. In FIG. 1, the mount subassembly of the invention has been rotated as far counterclockwise as allowed by mount platform angular retention holes 301. It is to be noted that any number of mount platform angular retention holes 301 may be present on base plate 100 of the invention, limited only by the available space on base plate 100. By rotating the mount subassembly about its pivot point and securing its distal end in any of the mount platform angular retention holes 301 using mount subassembly retaining pin 117, the mount subassembly may be releasably secured at any one of a variety of angles, offering a user the opportunity to train the muscles of the fingers, hand, wrist and forearm at any angle chosen by the user, and thus muscle training from use of the present invention may more closely mimic the real-world conditions encountered by rock climbers in which climbing holds are not always oriented on an axis convenient for the climber.

Referring still to FIG. 1, rear bumper 107 may be secured into place on the top surface of mount platform 101, preferably by mount subassembly retaining pin 117 which may engage mount platform angular retention holes 301 in a slight press fit that allows insertion of mount subassembly retaining pin 117 into mount platform angular retention holes 301 by hand, but which exhibits sufficient friction between mount subassembly retaining pin 117 and mount platform angular retention holes 301 that mount subassembly retaining pin 117 is releasably retained in mount platform angular retention holes 301. Alternatively, a threaded attachment means such as bolt and male threads in mount platform angular retention holes 301 may be utilized to retain mount subassembly retaining pin 117 in mount platform angular retention holes 301, or any means known by a person of ordinary skill in the art for attachment of structures may be used for engaging mount subassembly retaining pin 117 in mount platform angular retention holes 301. A preferred embodiment of rear bumper 107 comprises a cylindrical shaped exterior, and further comprises a hole, which may be a counterbored hole, substantially in the center thereof, with mount subassembly retaining pin 117 contained therein such that mount subassembly retaining pin 117 protrudes through the bottom surface of rear bumper 107 to engage in one of holes 301. Rear bumper 107 operates to limit the travel of the paddle subassembly to a pre-determined limit. Rear bumper 107 may be fabricated from any material such as wood, metal, phenolic, rubber, plastic and the like, but is preferably fabricated from rubber.

Referring still to FIG. 1, climbing hold 204 may be attached to the top surface of paddle top 200 to provide a hand grip surface for use in training. Climbing hold 204 may be attached to the top surface of paddle top 200 using a standard means for attachment of climbing holds as is known, for example, in the rock climbing arts and is discussed in further detail below in the discussion of the cross-sectional view shown in FIG. 4.

Still referring to FIG. 1, it is easily seen that a user of the invention may grasp climbing hold 204 and, pulling it away from resistance element bulkhead 106, will encounter increasing resistance until the paddle subassembly of the invention bottoms out against rear bumper 107. It should be noted that the resistance of the invention may be any level desired by the user and may be modified or changed from time to time by changing resistance elements 202 to elements that exhibit greater or lesser elasticity, or by adding or subtracting resistance elements 202. The improved upper extremity training apparatus of the invention is also adaptable to any style of climbing hold 204, as climbing hold 204 may be interchangeable as is discussed in further detail below.

Referring now to FIG. 2, a perspective top view of a preferred embodiment of the improved upper extremity training apparatus of the invention, with the sliding paddle of the invention shown in the resting position in which paddle top 200 is pulled against first mount bumper 104 and second mount bumper 105 by the tension of resistance elements 202 as hereinbefore described. Arrows B indicate the rotatable motion of the mount subassembly also as hereinbefore described, in which the mount subassembly may be rotated into one of several discrete angular positions. Mount platform angular retention holes 301 may be placed in an arcurate pattern so as to facilitate the rotation and locking into place of the mount subassembly into the angular position desired by the user.

Still referring to FIG. 2, resistance element bulkhead 106 may be attached to mount platform 101 by a plurality of resistance element bulkhead attachment hardware 111, which may be, for example, screws or bolts passing through holes, which may be counterbored holes, in resistance element bulkhead 106 and wherein said plurality of resistance element bulkhead attachment hardware 111 are threadingly engaged with receiving matching female threads adapted to receive resistance element bulkhead attachment hardware 111 and which are located in the proximal end face of mount platform 101. Likewise, first mount bumper 104 and second mount bumper 105 may be attached to first mount rail 102 and second mount rail 103, respectively, by the use of a plurality of mount bumper attachment hardware 112 passing through counterbored holes located in first mount bumper 104 and second mount bumper 105, and are threadingly engaged with receiving matching female threads adapted to receive mount bumper attachment hardware 112 which are located in the top surface of first mount rail 102 and second mount rail 103. Rear bumper 107, retaining pin 117 and resistance element end caps 203 are shown for reference.

Figure 3A:
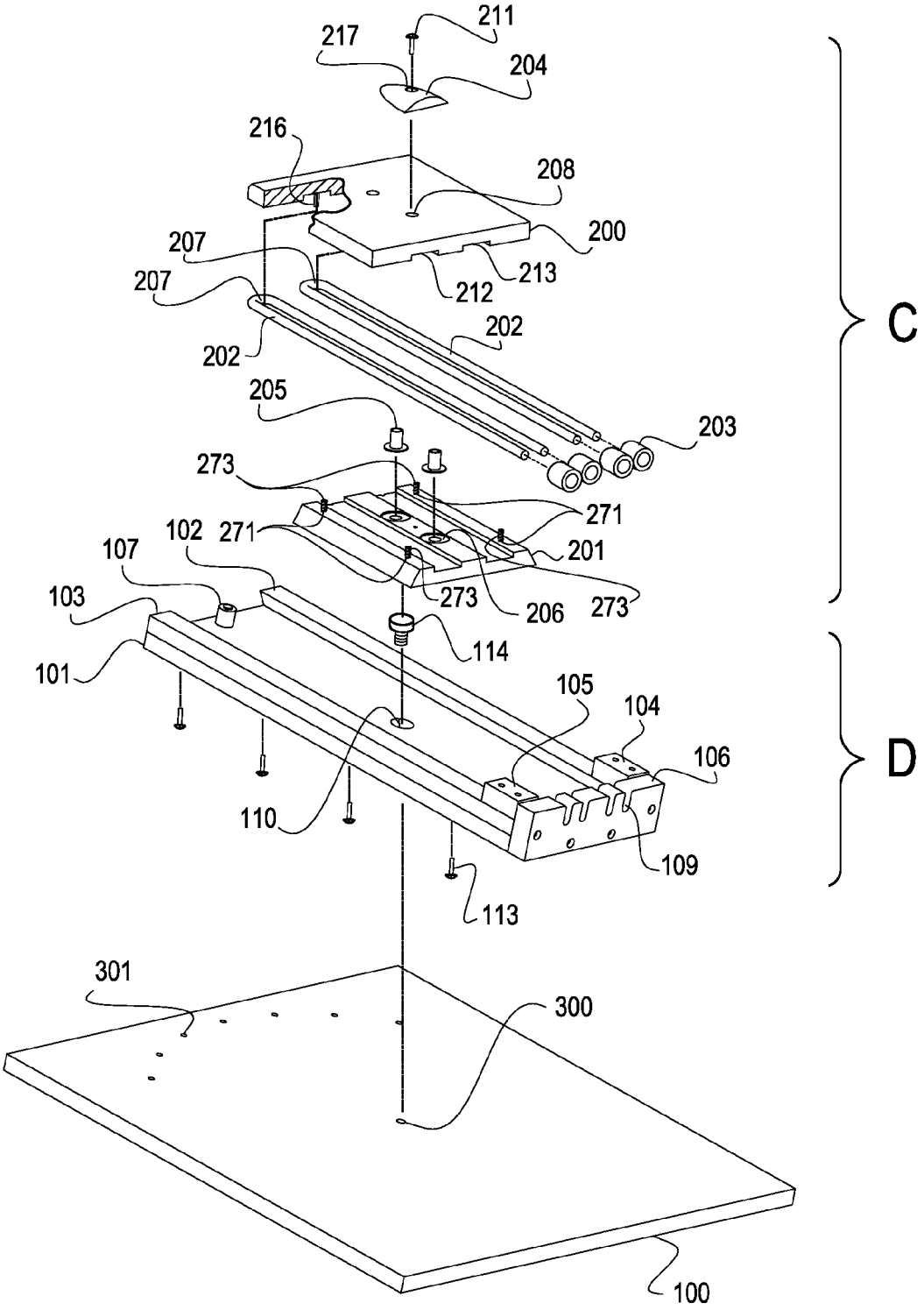
FIG. 3*a* depicts a perspective exploded view of a preferred embodiment of the improved upper extremity training apparatus of the invention, in which the paddle top and paddle bottom of the invention are releasably attached by threaded fasteners.
Figure 3B:
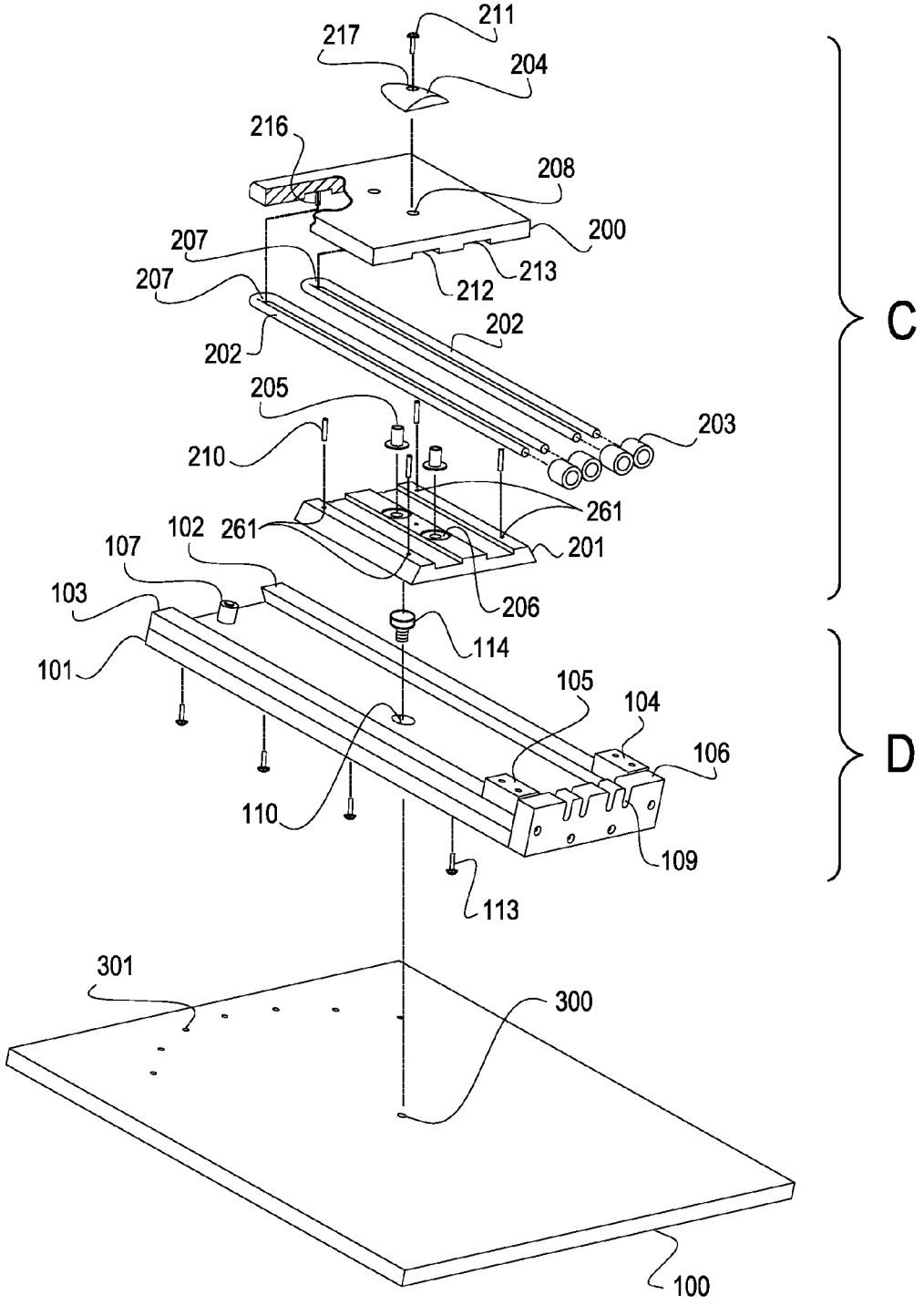
FIG. 3*b* depicts a perspective exploded view of an alternate embodiment of the improved upper extremity training apparatus of the invention in which the paddle top and paddle bottom of the invention are releasably attached by pins utilizing a press fit.

Referring now to FIGS. 3*a* and 3*b*, a perspective exploded view of the invention is shown. The paddle subassembly is depicted as group of elements C and the mount subassembly is depicted as group of elements D.

Still referring to FIGS. 3*a* and 3*b*, climbing hold 204 is removably attached to the upper surface of paddle top 200 as follows. Climbing hold retaining bolt 211 which may be a threaded fastener comprising male threads, may pass through climbing hold clearance hole 217 in climbing hold 204, and climbing hold retaining bolt 211 may further pass through climbing hold paddle top hole 208, which may be a clearance hole located in paddle top 200, to be threadingly received by a matching female threaded hole in climbing hold retaining nut 205. In alternate embodiments, a plurality of climbing hold retaining bolts, clearance holes, climbing hold retaining nuts, and climbing hold retaining nut counterbores may comprise the invention. Climbing hold retaining nut 205 may reside in climbing hold retaining nut counterbore 206. In an alternate embodiment of the invention, climbing hold retaining bolt 211 may pass through climbing hold clearance hole 217 in climbing hold 204 to be received and to be threadingly engaged by female threads in hole 208. A plurality of climbing holds 204, climbing hold retaining bolts 211, climbing hold clearance holes 217, climbing hold retaining nuts 205 and climbing hold retaining nut counterbores 206 may comprise the invention. It is therefore possible and within the scope of the invention that a plurality of climbing holds 204 may be removably attached to the upper surface of paddle top 200. The invention may comprise any number of climbing holds. However, for clarity, only one climbing hold 204 is depicted in FIGS. 1-6*b* as being removably attached to the upper surface of paddle top 200.

Figure 4A:
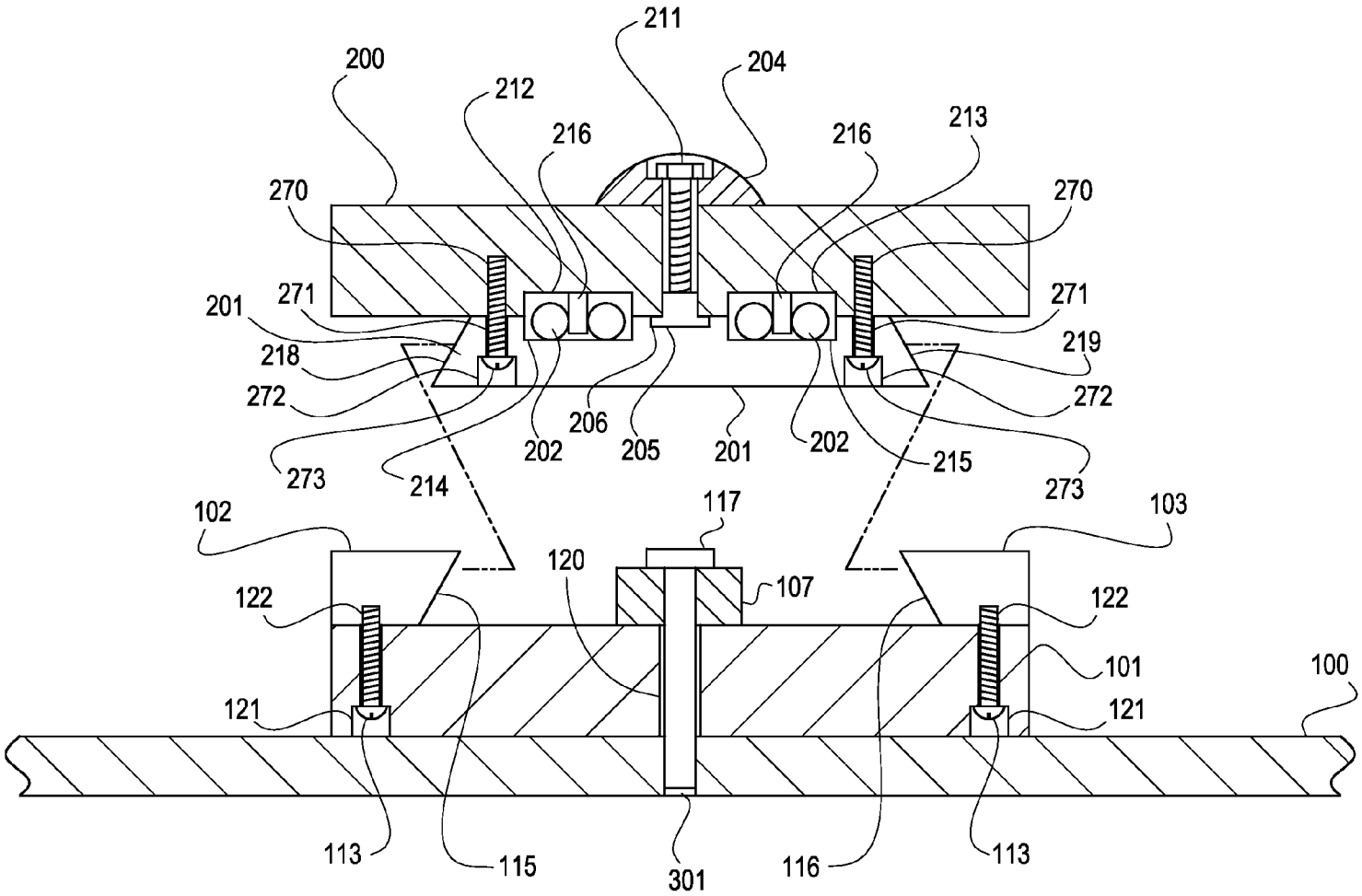
FIG. 4*a* depicts a cross-sectional view of a preferred embodiment of the paddle assembly of the improved upper extremity training apparatus of the invention in which the paddle top and paddle bottom of the invention are releasably attached by threaded fasteners.
Figure 4B:
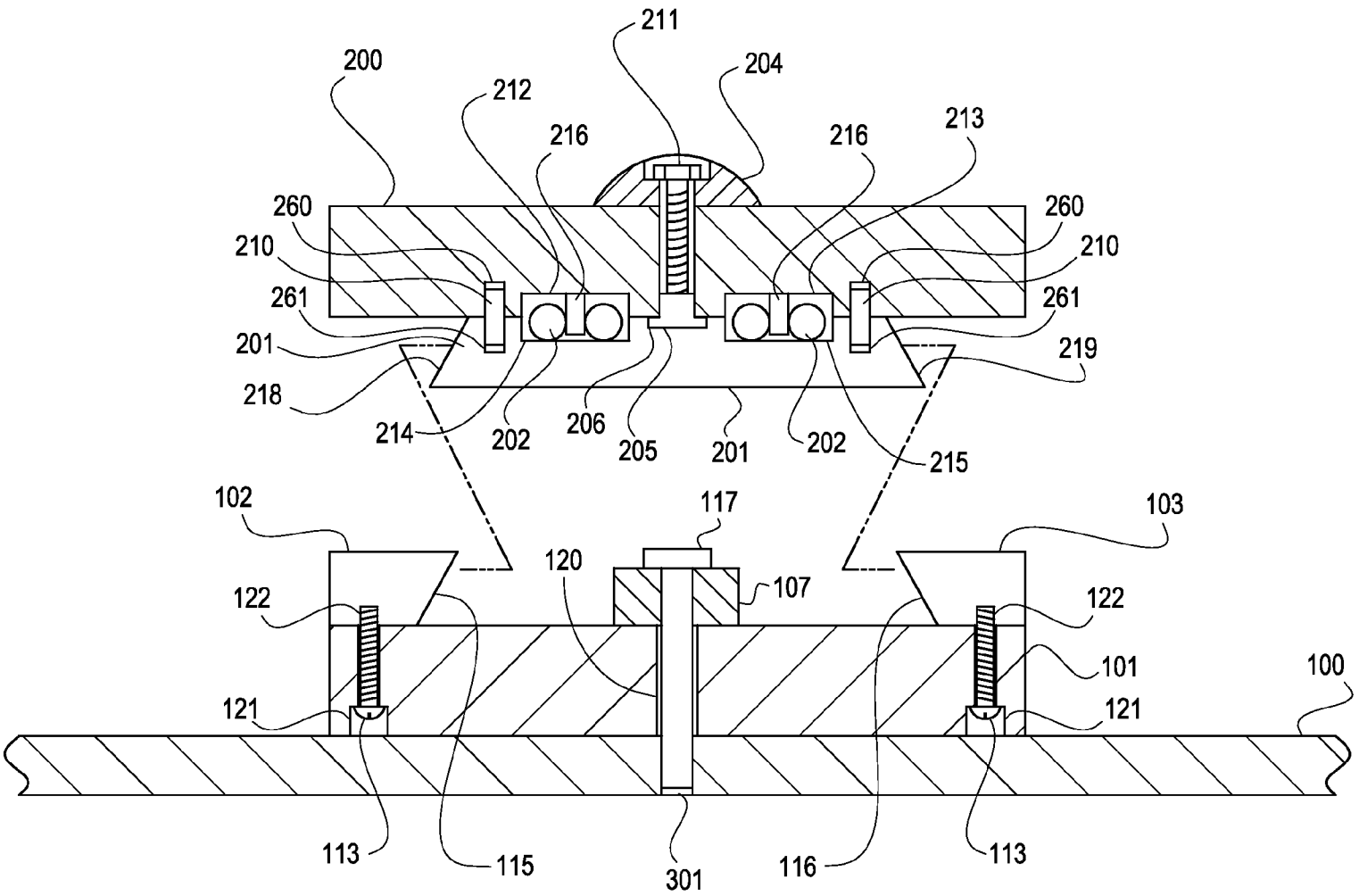
FIG. 4*b* depicts a cross-sectional view of an alternate embodiment of the paddle assembly of the improved upper extremity training apparatus of the invention in which the paddle top and paddle bottom of the invention are releasably attached by press fit pins.

Paddle top 200 and paddle bottom 201 may be releasably attached by any means known in the art. In FIGS. 3*a*, 3*b*, 4*a* and 4*b* of the drawings, two of the many included methods and structures for releasably attaching paddle top 200 and paddle bottom 201 are depicted. FIGS. 3*a* and 4*a* depict a preferred embodiment of the releasable attachment of paddle top 200 to paddle bottom 201 in which paddle top 200 and paddle bottom 201 may be releasably attached by at least one, but preferably a plurality, of threaded fasteners 273 passing up through clearance holes 271 in paddle bottom 201, which may further comprise counterbores 272 in paddle bottom 201 (not shown in FIG. 3*a* but shown in FIG. 4*a*) and received by matching female threaded holes 270 in the underneath side of paddle top 200. In this manner paddle top 200 may be released from paddle bottom 201 by removing threaded fasteners 273, allowing paddle top 200 and paddle bottom 201 to be separated. Referring next to FIGS. 3*b* and 4*b*, an alternative embodiment of releasable attachment of paddle top 200 to paddle bottom 201 may be at least one, but preferably a plurality, of pins 210 that may be received by a press fit into holes 261 located in paddle bottom 201 and may also be received by press fit into holes 260 located in the underside of paddle top 200 (not shown in FIG. 3*b* but shown in FIG. 4*b*). Thus, in the alternate embodiment shown in FIGS. 3*b* and 4*b*, when paddle top 200 and paddle bottom 201 are pressed together, the plurality of pins 210 are pressed into matching receiving holes 260 located in the underside of paddle top 200 in a press fit, and, by virtue of the press fit between pins 210 and the receiving holes 260 in paddle top 200 and holes 261 in paddle bottom 201, paddle top 200 and paddle bottom 201 may be releasably attached.

Referring again to FIGS. 3*a* and 3*b*, the invention may also comprise a first and second resistance element retaining pin 216 that may be received in a press fit by matching holes in the underside of paddle top 200, located in paddle top first groove 212 (shown in cross-sectional view in FIGS. 4*a* and 4*b*) and paddle top second groove 213 (shown in exploded view of FIGS. 3*a* and 3*b*). Resistance elements 202 form a loop around first and second resistance element retaining pins 216 at resistance elements loop end 207 so as to provide a contact point between resistance elements 202 and the paddle subassembly. As described hereinbefore, resistance element end caps 203 are attached to the ends of resistant elements 202. Still referring to FIGS. 3*a* and 3*b*, pivot point bolt 114 resides in mount subassembly rotation counterbored hole 110 and passes through the bottom of mount platform 101 to be received in a threading engagement with matching female threads located in hole 300, which is located in base plate 100. Mount rail attachment hardware 113, which may be threaded fasteners which are received by male threaded holes in first mount rail 102 and second mount rail 103 (shown in further detail in FIGS. 4*a* and 4*b*), rivets which may be received by holes in first mount rail 102 and second mount rail 103, press pins which may be received by receiving holes in first mount rail 102 and second mount rail 103 in a press fit, or any other equivalent means of mechanical fasteners known in the art may be used to affix first mount rail 102 and second mount rail 103 to mount platform 101. First mount bumper 104, second mount bumper 105, resistance element bulkhead 106 and resistance element retaining slots 109 are shown for reference.

Referring now to FIGS. 4*a* and 4*b*, a cross-sectional view of the invention is shown. Climbing hold 204 is removably attached to the upper surface of paddle top 200 by the threading engagement of climbing hold retaining bolt 211 into receiving female threads located in climbing hold retaining nut 205, which may reside in counterbore 206 located in an upper surface of paddle bottom 201. Paddle top 200 may further comprise paddle top first and second grooves 212 and 213 running lengthwise along its bottom surface. Paddle bottom 201 may likewise comprise paddle bottom first and second grooves 214 and 215, respectively, which run lengthwise along its upper surface. Paddle top first groove 212 is aligned with paddle bottom first groove 214 and paddle top second groove 213 is aligned with paddle bottom second groove 215 so as to form two lengthwise cavities which are able to accept resistance elements 202.

Still referring to FIGS. 4*a* and 4*b*, first paddle bottom gib surface 218 and second paddle bottom gib surface 219 are adapted to be received by first mount rail gib surface 115 and second mount rail gib surface 116 in a sliding engagement such that the paddle subassembly of the invention is enabled to slide smoothly upon the mount subassembly of the invention without binding along its length of travel. The first and second mount rail gib surfaces 115 and 116 of the invention are oriented on an angle such that the paddle subassembly is slidingly retained and cannot fall out of the track created by first mount rail gib surface 115 and second mount rail gib surface 116 when, for example, invention is turned upside down. Alternate structures may be used for such retention and sliding engagement, such as, for example, tongue and groove structures, structure with curvilinear cross section and other structures known in the art that are able to retain structural elements as a sliding engagement that allow movement along a longitudinal axis while maintaining the position of the sliding elements in a transverse direction. Mount rail attachment hardware 113, which may be threaded fasteners which are received by male threaded holes 122 in first mount rail 102 and second mount rail 103, rivets which may be received by receiving holes in first mount rail 102 and second mount rail 103, press pins which may be received by receiving holes in first mount rail 102 and second mount rail 103 in a press fit, or any other equivalent means of mechanical fasteners known in the art may be used to affix first mount rail 102 and second mount rail 103 to mount platform 101. In the case where mount rail attachment hardware 113 are threaded fasteners they may be received by counterbored holes 121 in mount platform 101 in a clearance fit, and the threaded portion of mount rail attachment hardware 113 may be received by matching male threads 122 in first mount rail 102 and second mount rail 103 as depicted in the cross sectional view of FIG. 4. First and second resistance element retaining pins 216, preferably pressed into matching receiving holes in paddle top 200 in a press fit, are also depicted.

Figure 5A:
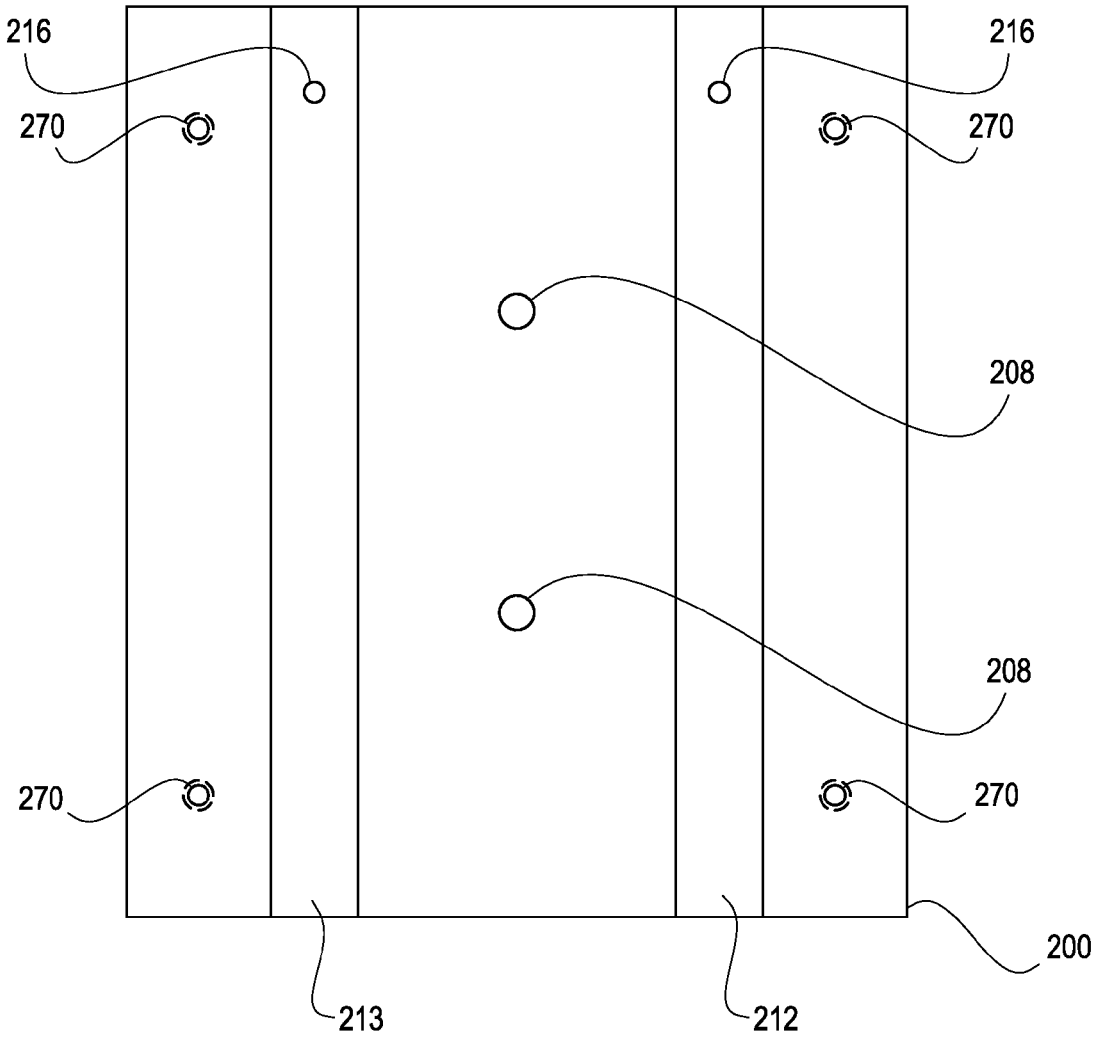
FIG. 5*a* depicts a bottom view of the paddle top of a preferred embodiment of the improved upper extremity training apparatus of the invention, in which threaded holes are shown for receiving threaded fasteners for releasably attaching the paddle top and paddle bottom together.
Figure 5B:
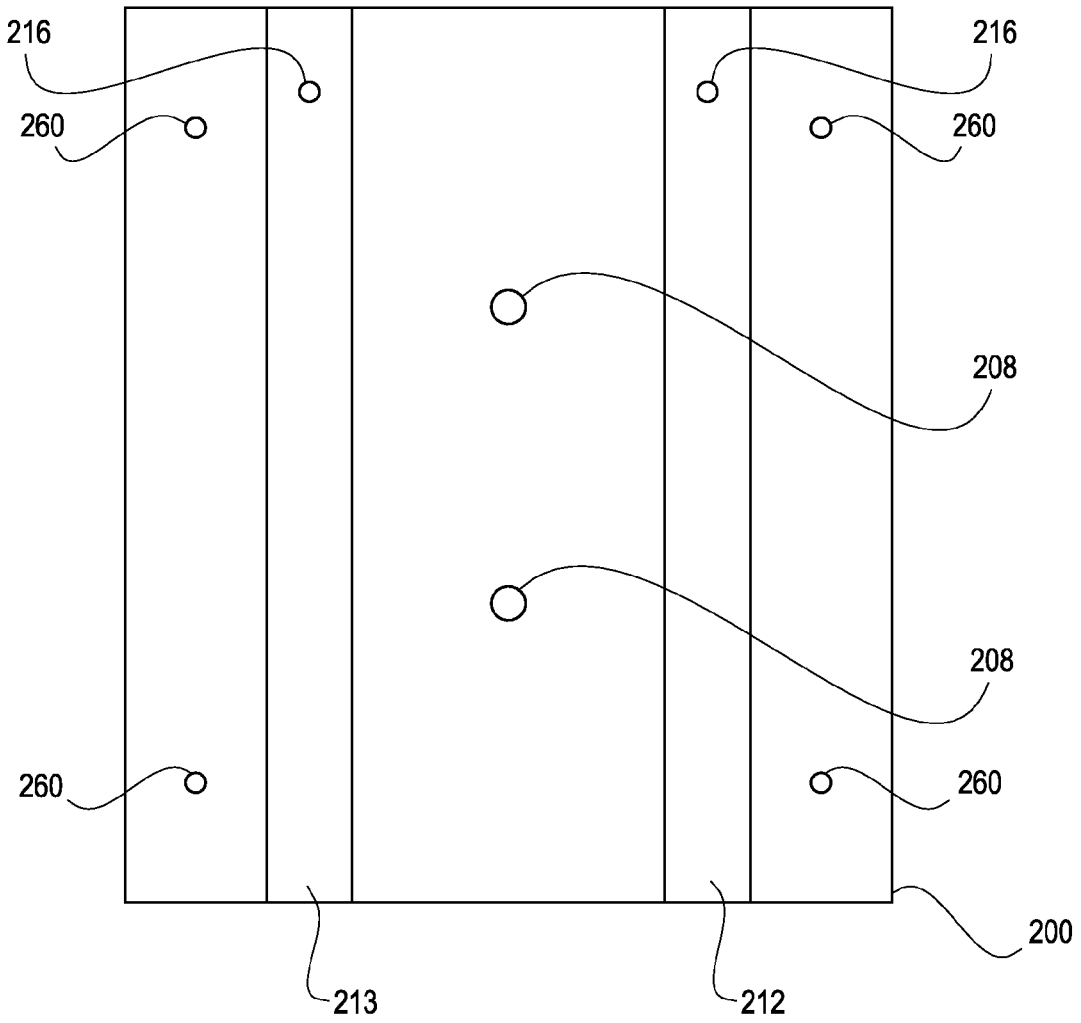
FIG. 5*b* depicts a bottom view of the paddle top of an alternate embodiment of the improved upper extremity training apparatus of the invention, in which holes are shown for receiving press fit pins for releasably attaching the paddle top and paddle bottom together.

Referring now to FIGS. 5*a* and 5*b*, a bottom view of paddle top 200 is depicted. First and second resistance element retaining pins 216 are, preferably, pressed into matching receiving holes in paddle top 200 in a press fit where they may operate to retain resistance elements 202 (not shown in FIGS. 5*a* and 5*b*, but shown in FIGS. 3*a*, 3*b*, 4*a* and 4*b*) at resistance element loop ends 207 (also not shown in FIGS. 5*a* and 5*b* but shown in FIGS. 3*a* and 3*b*). Climbing hold paddle top hole 208 located in paddle top 200, which may be adapted to allow climbing hold retaining bolt 211 (not shown in FIGS. 5*a* and 5*b* but shown in FIGS. 3*a* and 3*b*) to pass through paddle top 200, are shown. In an alternate embodiment of the invention, climbing hold paddle top hole 208 may comprise female threads adapted to threadingly engage climbing hold retaining bolt 211. Paddle top first groove 212 and paddle top second groove 213 (also shown in cross-sectional view in FIGS. 4*a* and 4*b*), which run lengthwise along a longitudinal axis of paddle top 200, are also depicted in FIGS. 5*a* and 5*b*.

Referring now to FIG. 5*a*, a preferred embodiment of the invention is depicted in which threaded holes 270, which may be adapted to receive male threaded fasteners 273 (not shown in FIG. 5*a* but shown in FIGS. 3*a* and 4*a*) are shown for use in the releasable attachment of paddle top 200 to paddle bottom 201.

Referring now to FIG. 5*b*, an alternative embodiment of the invention is depicted in which at least one, but preferably a plurality, of holes 260 in paddle top 200 are adapted to receive at least one but preferably a plurality of pins 210 (not shown in FIG. 5*b*, but shown in FIGS. 3*b* and 4*b*) in a press fit such that when paddle top 200 and paddle bottom 201 are pressed together, pins 210 are pressed into holes 260 thereby releasably attaching paddle top 200 and paddle bottom 201 together. Paddle bottom 201 is not depicted in FIG. 5*b* but is depicted in FIGS. 3*b* and 4*b*). Plurality of pins 210 may be received by a press fit into holes 261 located as shown in paddle bottom 201 and may also be received by press fit into holes 260 located in the underside of paddle top 200 as depicted in the cross section view of FIG. 4*b*.

Figure 6B:
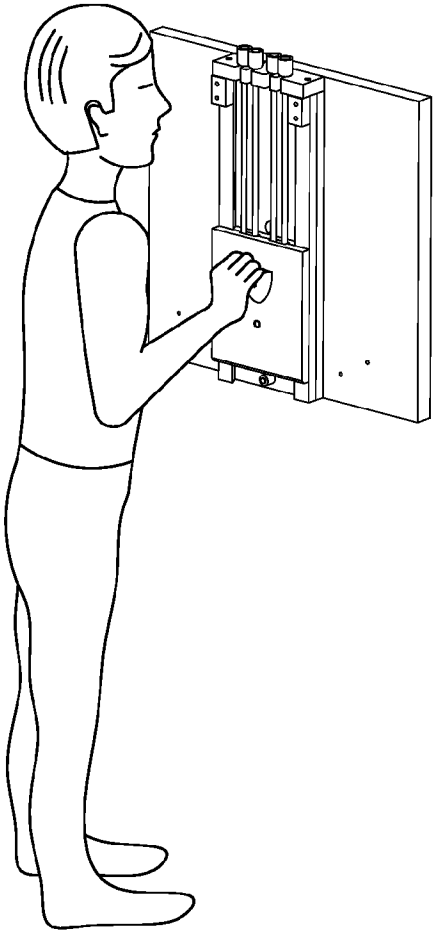
FIG. 6*b* depicts a preferred embodiment of the improved upper extremity training apparatus of the invention in use in an extended position.
Figure 6A:
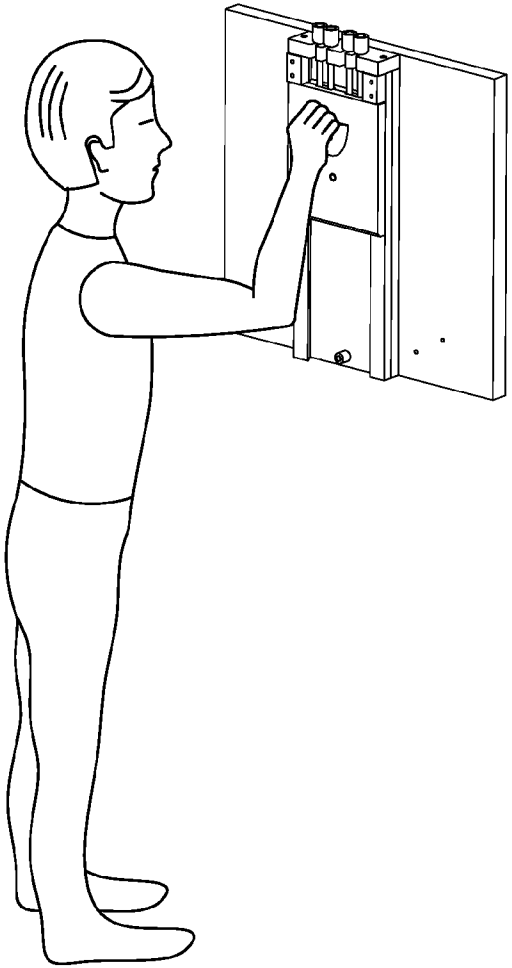
FIG. 6*a* depicts a preferred embodiment of the improved upper extremity training apparatus of the invention in use in a resting position.

Referring now to FIG. 6*a*, a user is shown addressing the invention, and the invention is in the resting position. Referring now to FIG. 6*b*, a user is using the invention, and the invention is shown in the extended position. It can easily be seen that the invention provides training for the fingers, hand, wrist, and forearms.

Figure 7B:
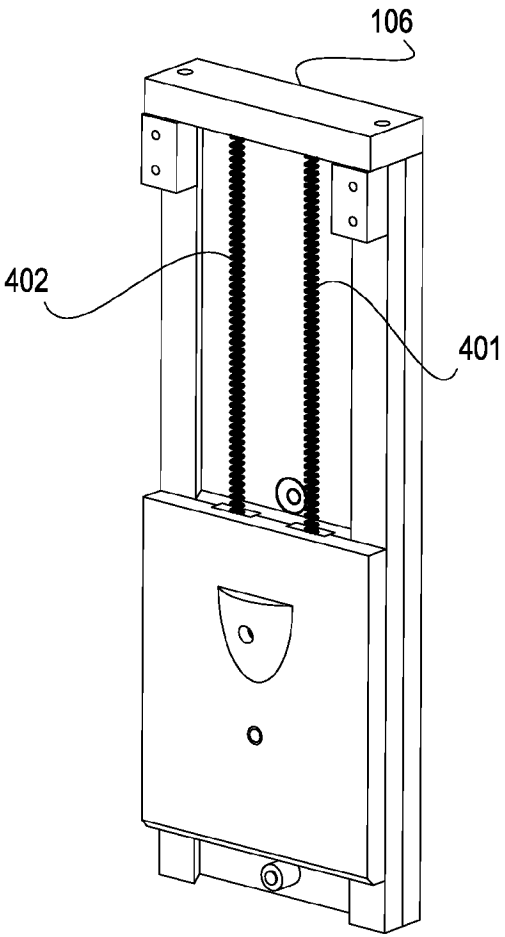
FIG. 7*b* depicts a first alternate embodiment of the invention comprising extension springs in use in an extended position.
Figure 7A:
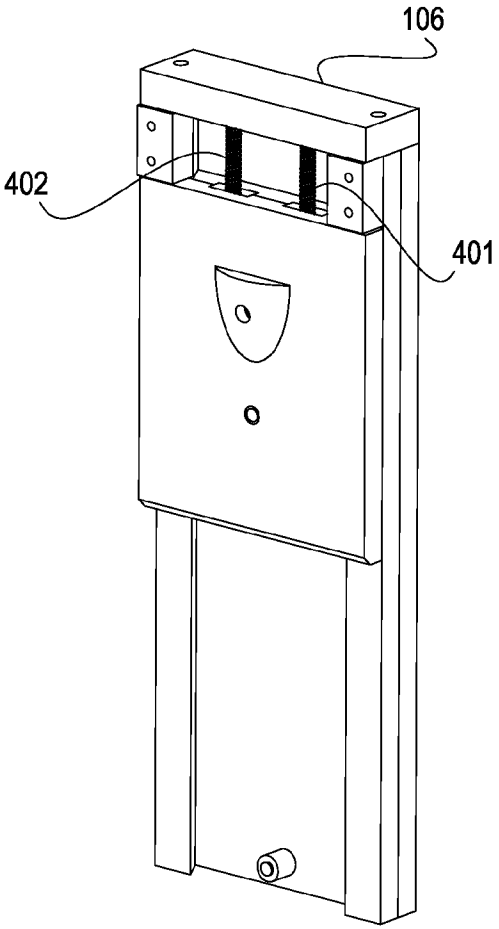
FIG. 7*a* depicts a first alternate embodiment of the invention comprising extension springs in use in a resting position.
Figure 7D:
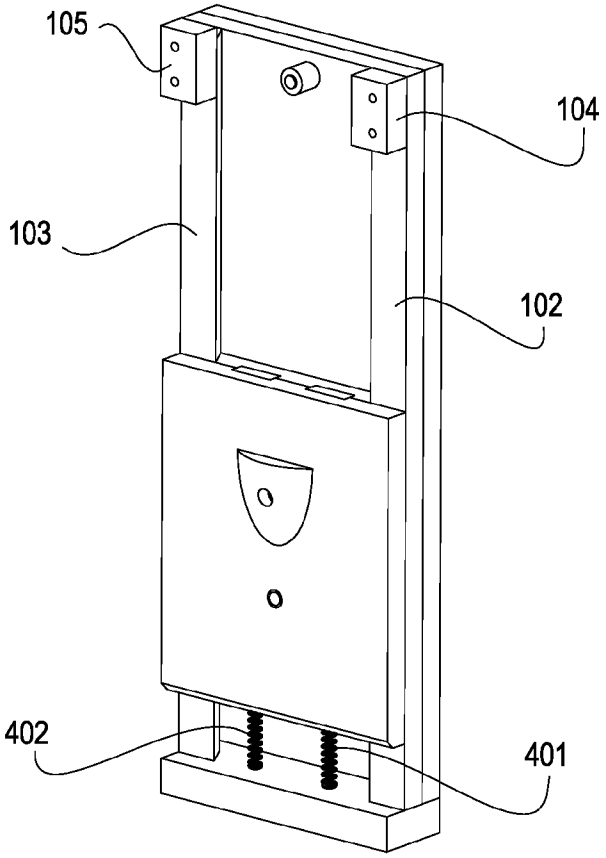
FIG. 7*d* depicts a second alternate embodiment of the invention comprising compression springs in use in an extended position.
Figure 7C:
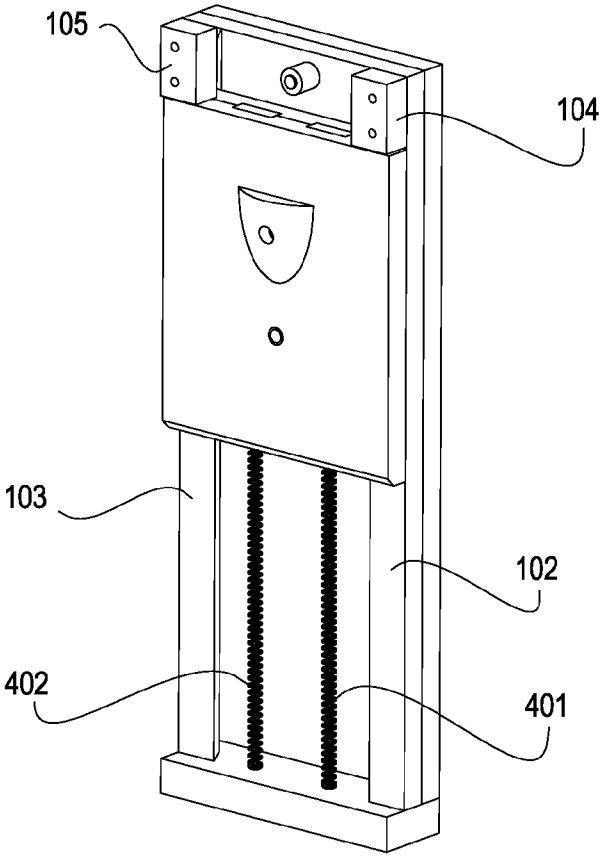
FIG. 7*c* depicts a second alternate embodiment of the invention comprising compression springs in use in a resting position.

Referring now to FIGS. 7*a*, 7*b*, 7*c* and 7*d*, alternate embodiments of the improved upper extremity training apparatus of the invention are depicted. FIGS. 7*a* and 7*b* depict the invention comprising extension springs which are attached to resistance element bulkhead 106 by any attachment means known in the art, and which are also attached to the paddle subassembly of the invention in similar manner as resistance elements 202 described above. In the alternate embodiment shown in FIGS. 7*a* and 7*b*, the springs operate in the same manner as resistance elements 202 described above; that is, in tension. Alternatively, FIGS. 7*c* and 7*d* depict another alternate embodiment of the invention, in which springs 401 and 402 are operating in compression, and in which first mount bumper 104 and second mount bumper 105 are re-located to the distal end of first mount rail 102 and second mount rail 103, respectively. These alternate embodiments are but two examples of the many alternate embodiments which embody the gist and spirit of the invention, which are all claimed herein as equivalent structures.

Figure 8:
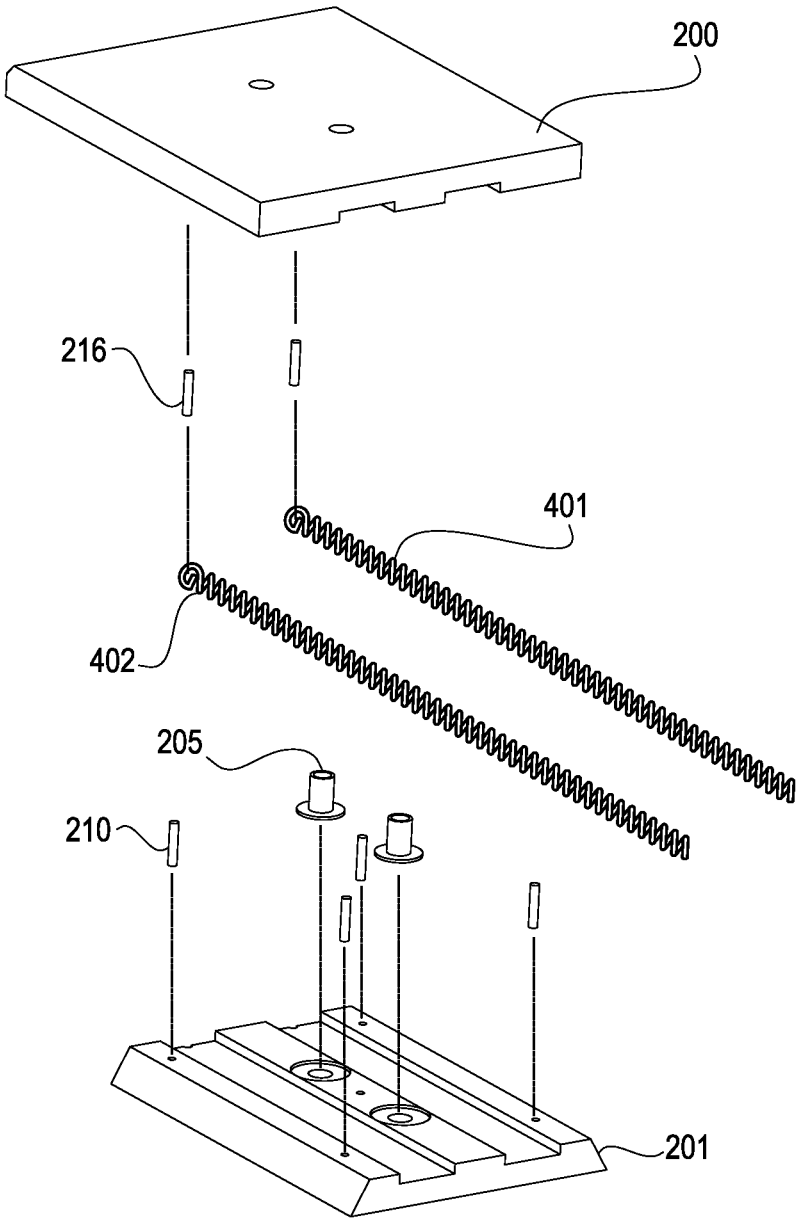
FIG. 8 depicts an exploded view of the first alternate embodiment of the invention comprising extension springs, in which the climbing hold is not shown; this figure depicts the retention of the extension springs the resistance element retaining pins of the invention.

Referring now to FIG. 8, an exploded view of the alternate embodiments depicted in FIGS. 7*a* through 7*d* is shown. It can be seen from this figure that springs 401 and 402 are attached to the paddle subassembly via first and second resistance element retaining pins 216 as in the preferred embodiment described above, and that at least one climbing hold retaining nut 205 may be located in climbing hold retaining nut counterbores and may comprise female threaded holes to receive a climbing hold retaining bolt as described in the preferred embodiment above, and as shown in FIGS. 3*a* and 3*b*. Likewise, a plurality of pins 210 may be received by a press fit into holes located as shown in paddle bottom 201 and may also be received by press fit into holes located in the underside of paddle top 200.

In the above description certain specific hardware in fastener configurations have been described in which counterbored holes and the like are defined as being present in a preferred embodiment of the invention. Furthermore, certain methods of manufacture of the various components of the invention may be either implied or expressly stated. It is to be understood that specific hardware definitions and methods of manufacture are not to be considered limitations of the invention, and that the scope and breadth of the claims appended hereto include all equivalent structures as our well known in the mechanical arts. As an example, while counterbored holes are described in the above description as a feature of resistance element bulkhead 106 as regards the attachment of resistance element bulkhead 106 to mount platform 101, it is to be understood that counterbored holes are not specifically required, and that any form of attachment that is known in the art is included within the scope of the claims. Likewise, the above description identifies mount platform 101, first mount rail 102, second mount rail 103 and resistance element bulkhead 106 as comprising separate pieces such as would be manufactured by, for example, standard machining processes. However, it is to be understood that these elements may also be fabricated from a single piece or may be manufactured using techniques known in the art such as welding, casting, molding or other types of unitary construction. Such alternate means of manufacturing are included within the scope and breadth of the claims as these manufacturing techniques are well known in the art as alternative means for producing equivalent structures. Use of such alternate means of manufacturing is included within both the gist of the invention as described herein and within the technical scope of the claims appended hereto.

Base plate 100, mount platform 101, first mount rail 102, second mount rail 103, resistance element bulkhead 106, paddle top 200, and paddle bottom 201 may be fabricated from materials known in the art to be suitable for structural use such as is anticipated by the improved upper extremity training apparatus of the invention. Such materials include, but are not limited to, wood, metal, plastic, phenolic, and any other material that is known in the mechanical arts that is suitable for fabrication of such structures as are described herein. Likewise, first mount bumper 104, second mount bumper 105, and rear bumper 107 may be fabricated from any material known in the art for structural use such as is anticipated by the invention, but are preferably rubber. It is to be noted, however, that wood, metal, plastic, phenolic and other rigid materials as are known in the art are also usable for these items and are therefore within the scope of the claims.

Although a detailed description as provided in the attachments contains many specifics for the purposes of illustration, anyone of ordinary skill in the art will appreciate that many variations and alterations to the following details are within the scope of the invention. Accordingly, the preferred embodiments of the invention are set forth herein without any loss of generality to, and without imposing limitations upon, the claimed invention. Thus, the scope of the invention should be determined by the appended claims and their legal equivalents, and not merely by the preferred examples or embodiments given.

What is claimed is:

1. An improved upper extremity training apparatus, comprising:

a paddle subassembly comprising:

a paddle top having an upper surface, a lower surface, a paddle top first groove and a paddle top second groove, at least one paddle top clearance hole disposed in said paddle top, wherein said paddle top first groove and said paddle top second groove are disposed lengthwise in said paddle top lower surface, and wherein said paddle top first groove and said paddle top second groove further comprise a resistance element retaining pin disposed in a distal end thereof;

a paddle bottom having an upper surface, a lower surface, a first side, a second side, a first paddle bottom gib surface disposed lengthwise along said first side of said paddle bottom and a second paddle bottom gib surface disposed to run lengthwise along said second side of said paddle bottom wherein said first and second paddle bottom gib surfaces form a male portion of a dovetail slide, a paddle bottom first groove and a paddle bottom second groove, wherein said paddle bottom first groove and said paddle bottom second groove are disposed lengthwise in said paddle bottom upper surface;

at least one elongate resistance element comprised of elastic structure having a first end and a second end, said first end and said second end each further comprising an end cap, at least one climbing hold retaining nut disposed in said at least one paddle top clearance hole; and a climbing hold, wherein said climbing hold is releasably attached to said upper surface of said paddle top by at least one climbing hold retaining bolt passing through said climbing hold and forming a threading engagement with said climbing hold retaining nut, and wherein said paddle top lower surface is attached to said paddle bottom upper surface such that said paddle top first groove is substantially aligned with said paddle bottom first groove and said paddle top second groove is substantially aligned with said paddle bottom second groove forming channels adapted to accept said at least one resistance element, and wherein said at least one resistance element is disposed within at least one of said channels forming a loop passing around said resistance element retaining pin: and a mount subassembly having a proximal end and a distal end, comprising:

a mount platform having an upper surface, a lower surface, a distal end, a proximal end, a first side, a second side and a counterbored hole passing through said mount platform and disposed substantially in the center of said mount platform, a first mount rail having an upper surface and a lower surface, a proximal end and a first mount rail gib surface, said first mount rail attached to said mount platform upper surface along said first side of said mount platform, a second mount rail having an upper surface and a lower surface, a proximal end and a second mount rail gib surface, said second mount rail attached to said mount platform upper surface along said second side of said mount platform, a first mount bumper attached to said upper surface of said first mount rail at said proximal end of said first mount rail, a second mount bumper, attached to said upper surface of said second mount rail at said proximal end of said second mount rail, a resistance element bulkhead attached to said proximal end of said mount platform, said resistance element bulkhead having an inner surface and an outer surface and comprising a plurality of resistance element retaining slots of sufficient width to accept said resistance elements, a mount subassembly retaining pin protruding from a distal end of said lower surface of said mount platform, and a rear bumper attached to said upper surface of said mount platform at said distal end of said mount platform, wherein said first mount rail gib surface and said second mount rail gib surface form a female portion of a dovetail groove;

wherein said male dovetail portion of said paddle subassembly is slidingly engaged with said female dovetail portion of said mount subassembly, wherein said at least one resistance element end caps are held in tension against said outer surface of said resistance element bulkhead when said paddle subassembly is slidingly engaged with said mount subassembly and is located so as to be in contact with said resistance element bulkhead inner surface.

2. The improved upper extremity training apparatus of claim 1 wherein said mount platform, resistance element bulkhead, paddle top and paddle bottom are fabricated from wood.

3. The improved upper extremity training apparatus of claim 2 wherein said at least one resistance elements are bungee cords.

4. The improved upper extremity training apparatus of claim 2 wherein said at least one resistance elements are elastic bands.

5. The improved upper extremity training apparatus of claim 1 wherein said mount platform, resistance element bulkhead, paddle top and paddle bottom are fabricated from metal.

6. The improved upper extremity training apparatus of claim 5 wherein said at least one resistance elements are bungee cords.

7. The improved upper extremity training apparatus of claim 5 wherein said at least one resistance elements are elastic bands.

8. The improved upper extremity training apparatus of claim 1 wherein said mount platform, resistance element bulkhead, paddle top and paddle bottom are fabricated from plastic.

9. The improved upper extremity training apparatus of claim 8 wherein said at least one resistance elements are bungee cords.

10. The improved upper extremity training apparatus of claim 8 wherein said at least one resistance elements are elastic bands.

11. The improved upper extremity training apparatus of claim 1 wherein said at least one resistance elements are bungee cords.

12. The improved upper extremity training apparatus of claim 1 wherein said at least one resistance elements are elastic bands.

13. An improved upper extremity training apparatus, comprising:

a base plate comprising a plurality of mount platform angular retention holes and a female threaded hole for receiving a male threaded fastener, wherein said mount platform angular retention holes are located in an arcurate pattern on an arc oriented with said female threaded hole at the center of said arc;

a paddle subassembly comprising:

a paddle top having an upper surface, a lower surface, a paddle top first groove and a paddle top second groove, at least one paddle top clearance hole disposed in said paddle top, wherein said paddle top first groove and said paddle top second groove are disposed lengthwise in said paddle top lower surface, and wherein said paddle top first groove and said paddle top second groove further comprise a resistance element retaining pin disposed in a distal end thereof;

a paddle bottom having an upper surface, a lower surface, a first side, a second side, a first paddle bottom gib surface disposed to run lengthwise along said first side of said paddle bottom and a second paddle bottom gib surface disposed to run lengthwise along said second side of said paddle bottom such that said first and second paddle bottom gib surfaces form a male portion of a dovetail slide, a paddle bottom first groove and a paddle bottom second groove, wherein said paddle bottom first groove and said paddle bottom second groove are disposed lengthwise in said paddle bottom upper surface;

at least one elongate resistance element comprised of elastic structure having a first end and a second end, said first end and said second end each further comprising an end cap, at least one climbing hold retaining nut disposed in said at least one paddle top clearance hole; and a climbing hold, wherein said climbing hold is releasably attached to said upper surface of said paddle top by at least one climbing hold retaining bolt passing through said climbing hold and forming a threading engagement with said climbing hold retaining nut, and wherein said paddle top lower surface is attached to said paddle bottom upper surface such that said paddle top first groove is substantially aligned with said paddle bottom first groove and said paddle top second groove is substantially aligned with said paddle bottom second groove forming channels adapted to accept said at least one resistance element, and wherein said at least one resistance element is disposed within at least one of said channels forming a loop passing around said resistance element retaining pin: and a mount subassembly having a proximal end and a distal end, comprising:

a mount platform having an upper surface, a lower surface, a distal end, a proximal end, a first side, a second side and a counterbored hole passing through said mount platform and disposed substantially in the center of said mount platform, a first mount rail having an upper surface and a lower surface, a proximal end and a first mount rail gib surface, said first mount rail attached to said mount platform upper surface along said first side of said mount platform, a second mount rail having an upper surface and a lower surface, a proximal end and a second mount rail gib surface, said second mount rail attached to said mount platform upper surface along said second side of said mount platform, a first mount bumper attached to said upper surface of said first mount rail at said proximal end of said first mount rail, a second mount bumper, attached to said upper surface of said second mount rail at said proximal end of said second mount rail, a resistance element bulkhead attached to said proximal end of said mount platform, said resistance element bulkhead having an inner surface and an outer surface and comprising a plurality of resistance element retaining slots of sufficient width to accept said resistance elements, a mount subassembly retaining pin protruding from a distal end of said lower surface of said mount platform, and a rear bumper attached to said upper surface of said mount platform at said distal end of said mount platform, wherein said first mount rail gib surface and said second mount rail gib surface form a female portion of a dovetail groove; and a pivot point bolt having male threads and a head;

wherein said male dovetail portion of said paddle subassembly is slidingly engaged with said female dovetail portion of said mount subassembly, and wherein said at least one resistance element end caps are held in tension against said outer surface of said resistance element bulkhead when said paddle subassembly is slidingly engaged with said mount subassembly and is located so as to be in contact with said resistance element bulkhead inner surface; and wherein said mount subassembly retaining pin is adapted to be received by one of said plurality of mount platform angular retention holes in said base plate, and wherein said pivot point bolt head is disposed in said counterbored hole in said mount platform and wherein said mount subassembly fastener is threadingly engaged with said female threaded hole in said base plate.

14. The improved upper extremity training apparatus of claim 13 wherein said base plate, mount platform, resistance element bulkhead, paddle top and paddle bottom are fabricated from wood.

15. The improved upper extremity training apparatus of claim 14 wherein said at least one resistance elements are bungee cords.

16. The improved upper extremity training apparatus of claim 14 wherein said at least one resistance elements are elastic bands.

17. The improved upper extremity training apparatus of claim 13 wherein said base plate, mount platform, resistance element bulkhead, paddle top and paddle bottom are fabricated from metal.

18. The improved upper extremity training apparatus of claim 17 wherein said at least one resistance elements are bungee cords.

19. The improved upper extremity training apparatus of claim 17 wherein said at least one resistance elements are elastic bands.

20. The improved upper extremity training apparatus of claim 13 wherein said base plate, mount platform, resistance element bulkhead, paddle top and paddle bottom are fabricated from plastic.

21. The improved upper extremity training apparatus of claim 20 wherein said at least one resistance elements are bungee cords.

22. The improved upper extremity training apparatus of claim 20 wherein said at least one resistance elements are elastic bands.

23. The improved upper extremity training apparatus of claim 13 wherein said at least one resistance elements are bungee cords.

24. The improved upper extremity training apparatus of claim 13 wherein said at least one resistance elements are elastic bands.

* * * * *